US005175473A

United States Patent [19]

Kim

[11] Patent Number: 5,175,473

[45] Date of Patent: Dec. 29, 1992

[54] PLASMA DISPLAY PANEL

[75] Inventor: Dae-il Kim, Suwon, Rep. of Korea

[73] Assignee: Samsung Electron Devices Co., Ltd., Kyunggi, Rep. of Korea

[21] Appl. No.: 632,386

[22] Filed: Dec. 24, 1990

[30] Foreign Application Priority Data

Dec. 22, 1989 [KR] Rep. of Korea ..... 89-19190

[51] Int. Cl.[5] ..... G09G 3/10

[52] U.S. Cl. ..... 315/169.4; 313/585; 313/586; 340/775

[58] Field of Search ..... 315/169.4; 313/584, 313/585, 586; 340/771, 775, 789

[56] References Cited

U.S. PATENT DOCUMENTS 3,559,190 1/1971 Bitzer et al. ..... 315/169.4
3,662,352 5/1972 Schott ..... 315/169.4
3,953,756 4/1976 Monfroy et al. ..... 313/586
3,956,667 5/1976 Veith ..... 315/169.4
4,005,402 1/1977 Amano ..... 340/779
4,160,932 7/1979 Mikoshiba et al. ..... 315/169.4
5,004,950 4/1991 Lee ..... 313/584

*Primary Examiner*—Eugene R. LaRoche
*Assistant Examiner*—Michael B. Shingleton
*Attorney, Agent, or Firm*—Cushman, Darby & Cushman

[57] ABSTRACT

A plasma display panel comprises a face plate, a rear plate, a plurality of anodes, cathodes, auxiliary anodes, first barrier ribs, second barrier ribs and discharge spaces. Each auxiliary anode is interposed between each first barrier rib and each second barrier rib. The PDP is easy to manufacture due to the absence of an applied dielectric layer. The circuit for driving the plasma display panel is simplified by using a DC auxiliary discharge. The width of the cathode is not limited by the auxiliary anode, but maximized because of the auxiliary anodes placement within the discharge space, so that the higher brightness is realized by the enhanced discharge.

4 Claims, 2 Drawing Sheets

PLASMA DISPLAY PANEL

FIELD OF THE INVENTION

The present invention relates to a plasma display panel, and particularly to a DC type plasma display panel which is easy to manufacture and has high brightness.

BACKGROUND OF THE INVENTION

Generally, a display device that displays characters or figures by gas discharge is referred to as a plasma display panel (hereinafter "PDP"). The PDP typically serves as a display device for office automation.

FIG. 1 is a perspective view of a trigger discharge PDP disclosed in U.S. Pat. No. 4,562,434. The disclosed trigger discharge PDP comprises face plate 1 and rear plate 2, which are spaced at a predetermined distance, a plurality of X-Y matrix anodes 5 and cathodes 7, trigger electrodes 3 and a dielectric layer 4.

The trigger electrodes 3, the dielectric layer 4 and the cathodes 7 are disposed sequentially on the inner surface of the rear plate 2, and the anodes 5 are formed on the face plate 1 and extend in the direction perpendicular to the cathodes 7. At the same time, barrier ribs 6 are disposed in the same direction as the anodes 5, bridging the face and rear plates, separates the respective cathodes from the adjacent anodes.

In this PDP, an AC auxiliary discharge is generated between the trigger electrodes 3 and the cathodes 7. The dielectric layer interposed therebetween helps generate the DC main discharge between the cathodes 7 and the anodes 5, which are spaced apart from each other in a space filled with a gas layer. The trigger discharge is induced between the anodes 5 and the cathodes 7 as well as between the trigger electrodes 3 and the cathodes 7, thereby depositing wall charge on the surface of the insulating layer 4, which triggers discharges between the cathodes and the trigger electrodes to facilitate the main discharge between the anodes 5 and cathodes 7. Since the trigger discharge PDP triggers the main discharge by the wall discharge deposited on the surface of the dielectric layer 4, it advantageously prevents flickering at the initial stage of the main discharge, which problem occurs in non-triggering discharge PDP's. Further, the response speed increases, thereby realizing a high resolution image having a high scanning density.

However, since the trigger discharge occurs by AC currents through the dielectric layer interposed between the trigger electrodes and the cathodes, the intended characteristics are difficult to achieve requiring a dielectric layer formed to exacting specifications. Because the dielectric insulating layer separates the cathodes from the trigger electrodes and also serves as the structure on which the wall discharge is deposited to help trigger the main discharge, the dielectric constant must meet exacting standards, and its insulation destruction tolerance characteristics are also exacting. Further, a complex circuit for generating trigger pulses is required to cause the trigger discharge through the dielectric layer.

In addition, conventional trigger discharge PDP's require a very flat surface on the trigger electrodes in order to prevent the charge concentration in any particular region. This requires that the trigger electrodes be made of an expensive organic metal paste containing gold as a main ingredient.

Moreover, in this trigger discharge PDP, the distance between the cathodes and anodes must be maintained relatively narrow in order to induce sufficient trigger discharge. This requires that the widths of the cathodes be relatively narrow. However, if the widths of the cathode become narrow, the strength of the main discharge is lowered, resulting in reduced brightness of the discharge light.

SUMMARY OF THE INVENTION

It is an object of the present invention to provide a PDP which can obviate the above problems of the prior art, and is manufactured easily and at low cost.

It is another object of the present invention to provide a PDP which has a sufficiently strong trigger discharge intensity and high brightness.

It is still another object of the present invention to provide a PDP in which the auxiliary discharge circuit is simplified.

In order to achieve above-mentioned objects, the present invention provides a PDP comprising;

a face plate and rear plate which are opposite to each other and spaced apart a predetermined distance;

a plurality of anodes formed parallel to one another at a predetermined interval on the inner surface of the face plate;

a plurality of cathodes arranged parallel to one another and extending perpendicularly to the anodes;

a plurality of first barrier ribs formed between the anodes on the face plate in the the anodes; same direction as a plurality of second barrier ribs disposed on the rear plate and respectively opposite to the first barrier ribs; and a plurality of auxiliary anodes interposed between each of the first and second barrier ribs.

The PDP according to the present invention contains exposed cathodes, anodes, and auxiliary anodes in a discharge space. The auxiliary discharge between the auxiliary anodes and the cathodes uses a DC trigger voltage. A DC main discharge between the cathodes and anodes is subsequentially generated by the auxiliary discharge and DC main voltage. In the PDP of the present invention as described above, the auxiliary anodes can be easily manufactured. Further, since the trigger discharge uses a DC voltage, the trigger discharge circuit is also simplified.

BRIEF DESCRIPTION OF THE DRAWINGS

Other objects and advantages of the present invention will become more apparent by the following detailed description of the preferred embodiment with reference to accompanying drawings, in which.

DETAILED DESCRIPTION OF THE PREFERRED EMBODIMENT

Figure 1:
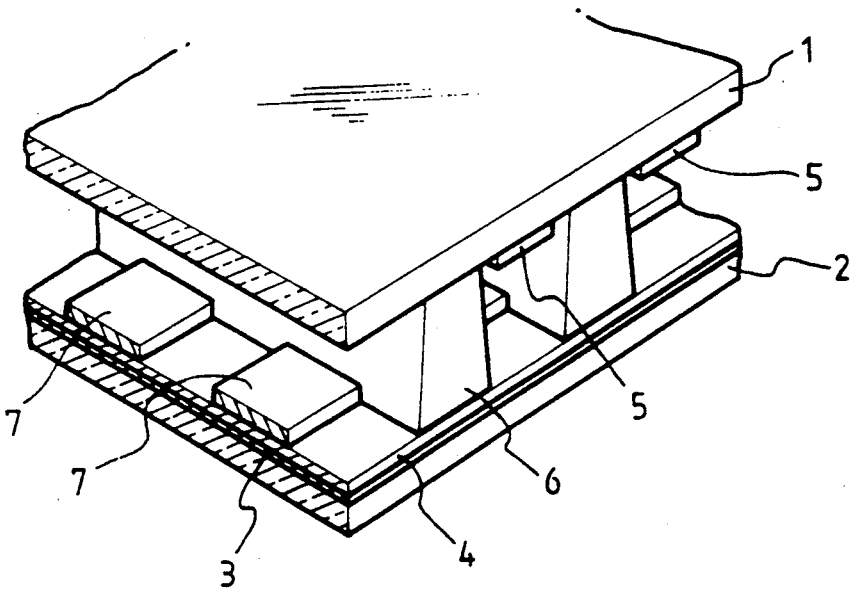
FIG. 1 (PRIOR ART)
FIG. 1 is a perspective view of a conventional PDP.
Figure 2:
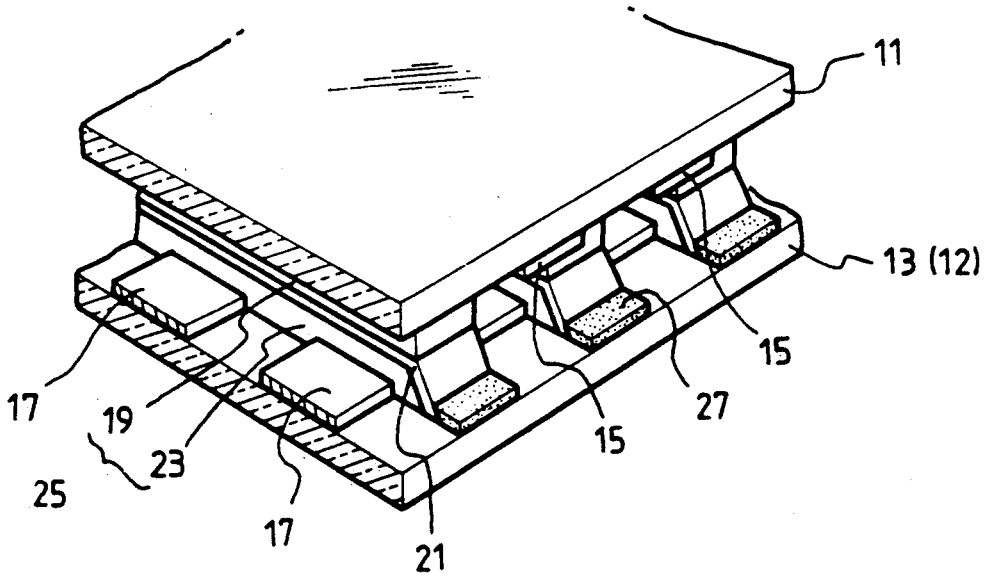
FIG. 2 is a partially broken away perspective view of one preferred embodiment of the PDP according to the present invention.
Figure 3:
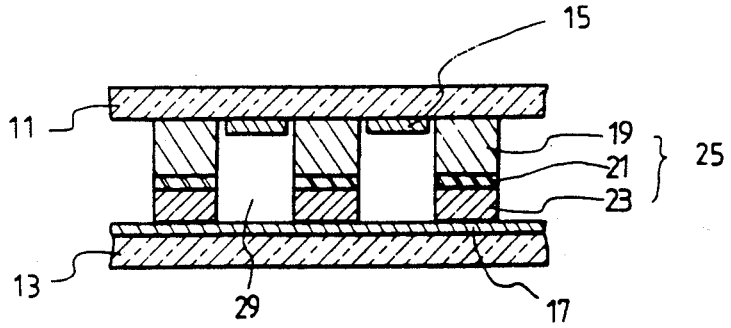
FIG. 3 is a cross-sectional view of the PDP shown in FIG. 2.

As shown in FIGS. 2 and 3, a plurality of anodes 15 in strip arrangement are disposed parallel to one another on the inner surface of the transparent face plate 11. A plurality of cathodes 17 in strip arrangement are also disposed on the inner surface of the rear plate 13 in a direction perpendicular to the anodes 15. A plurality of barrier means 25 are arranged parallel to the anodes 15 between the face plate 11 and the rear plate 13, for isolating the respective anodes 15, and thus preventing cross talk. Each barrier means 25 contains a first barrier rib 19 formed on the face plate 11, a second barrier rib 23 formed on the rear plate 13, and an auxiliary anode 21 disposed between the first and second barrier ribs. The auxiliary anode 21 is inserted between the first barrier rib 19 and the second barrier rib 13, and is exposed to the discharge spaces 29 formed between ribs and filled with halogen gas. The end portions of the respective auxiliary anodes 21 are electrically connected to resistors 27 adhered on the surface of the rear plate 13.

Figure 4:
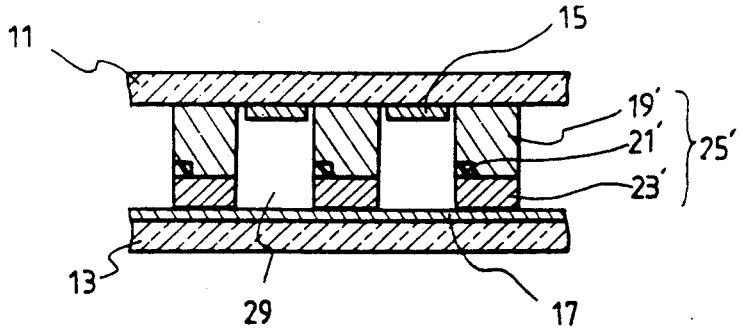
FIG. 4 is a schematic sectional view of another embodiment of the PDP according to the present invention.

FIG. 4 illustrates that auxiliary anodes 21', can be formed on only one side of discharge space 29, wherein the first barrier rib 19' and the second barrier rib 23' partially and directly contact each other.

In the PDP having this structure, the auxiliary anodes are exposed to the discharge space 29 filled with halogen gas, so that the width of the cathode 17 is not restricted by the auxiliary anodes 21' and a trigger discharge can be generated with a DC driving voltage.

The PDP of the present invention can be manufactured by ordinary techniques such as vacuum sputtering, photoetching, printing and so forth. In manufacture, nickel is used for anodes 15, cathodes 17 and auxiliary anodes 21, $RuO_2$ is used for the resistors 27, and nonconductive material, i.e., frit glass, is used for the first barrier ribs 23 and the second barrier ribs.

The aforesaid PDP according to the present invention operates as set forth below.

Figure 5:
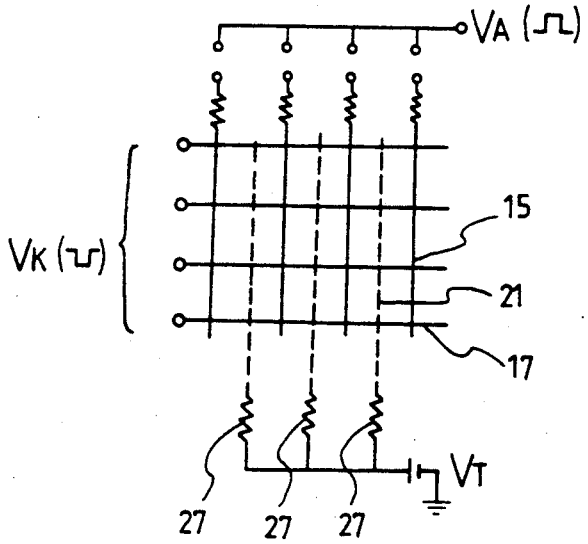
FIG. 5 is the equivalent circuit diagram of the PDP according to the present invention.
Figure 6:
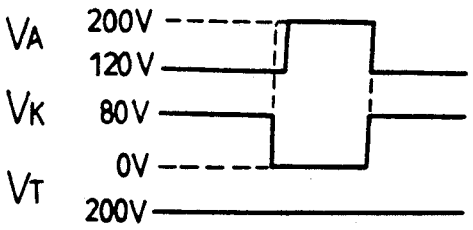
FIG. 6 is the wave patterns of the driving voltages of the PDP according to the present invention.

FIG. 5 is the equivalent circuit diagram of the PDP and FIG. 6 illustrates the wave patterns of the driving voltages of the PDP according to the present invention. Auxiliary discharge voltage VT of about 200V is periodically applied to the auxiliary anodes 21 through the resistor 27, resulting in an initial voltage of 120V applied to the anodes and 80V to the cathodes 17. When a cathode voltage VK, which is selected by synchronizing in response to the image signal and scanning signal, is shifted to a low state of 0V, the potential difference between the cathode 17 and the auxiliary anode 21 becomes great, resulting in an auxiliary discharge therebetween. Thereafter, when the anode voltage VA is shifted to high state of 200V, the main discharge occurs between the anodes 15 and cathodes 17 due to the highly densified space charge accumulated in the discharge space 29 by the auxiliary discharge.

The auxiliary discharge of the first embodiment of the present invention illustrated in FIGS. 2 and 3 is generated through the spaces formed at both sides of the auxiliary anode. In the second embodiment of the present invention, illustrated in FIG. 4, the auxiliary discharge is generated only through the space formed at the one exposed side of the auxiliary anode. Therefore, the second embodiment is preferable to the first embodiment in practical use.

In the PDP according to the present invention, because the auxiliary discharge is generated through the discharge space filled with halogen gas, the auxiliary discharge continues as long as a certain potential difference is maintained between the auxiliary anode and cathode. As a result, if the anode voltage is supplied to the anode by a synchronizing pulse, the auxiliary discharge continuously assists the main discharge.

Furthermore, the auxiliary discharge is generated between the auxiliary anode and the cathode which is positioned at a distance below the auxiliary anode. The auxiliary anode is narrow in width and is disposed between the first and second barrier ribs. Thus, the discharge current is restricted, thereby properly limiting the brightness of the auxiliary discharge light. The brightness difference between the auxiliary discharge light and the main discharge light becomes great, resulting in improved contrast of the display image.

According to the present invention, since the PDP is not provided with a dielectric layer different from the conventional trigger discharge type PDP, manufacturing the dielectric layer to exacting specifications is not required. Further, the auxiliary discharge uses a DC voltage and the auxiliary discharge circuit is markedly simplified.

In addition, the auxiliary anode of the PDP according to the present invention can be made of a common metal, e.g., nickel, so that the PDP can be manufactured at low cost and the manufacturing process is still further simplified.

Moreover, in the PDP according to the present invention, because the width of the cathode is not limited by the auxiliary anode and can be maximized within the discharge space, the strength of the main discharge is enhanced, thereby maximizing the brightness of the display image.

As will be apparent to those skilled in the art, various changes and modifications may be made to the plasma display panel of the present invention without departing from the spirit and scope of the invention as determined in the appended claims and their legal equivalent.

I claim:

1. A DC triggered plasma display panel comprising:

a face plate and a rear plate spaced apart from said face plate by a first predetermined distance;

a plurality of parallel anodes spaced at a predetermined interval on an inner surface of said face plate;

a plurality of cathodes arranged perpendicular to said anodes and parallel to one another on an inner surface of said rear plate;

a plurality of first barrier ribs arranged parallel to and between said anodes on said face plate;

a plurality of second barrier ribs formed on said rear plate aligned with said first barrier ribs and arranged perpendicular to said cathodes, thereby forming a plurality of discharge spaces between said face place and rear plate;

a plurality of auxiliary anodes sandwiched between said first and second barrier ribs, with at least one edge of said auxiliary nodes being exposed to the inner space between said face plate and rear plate, thereby causing an auxiliary discharge to develop between at least one of the auxiliary anodes and at lest one of the cathodes in response to a trigger voltage; and voltage triggering means coupled to said plurality of auxiliary anodes and said plurality of cathodes for selectively generating the trigger voltage across said at least one auxiliary anode and said at least one cathode, wherein each of said first barriers rib and a corresponding one of said second barrier ribs are in partial contact with each other, the only one edge of each of said auxiliary anodes is exposed to said discharge space.

2. A plasma display panel according to claim 1, wherein said anodes, cathodes, and auxiliary anodes are formed substantially of a common metal.

3. A plasma display panel according to claim 2, wherein said common metal is nickel.

4. A plasma display panel according to claim 1, wherein said trigger voltage is a D.C. trigger voltage.

* * * * *